US007377661B2

(12) United States Patent
Douglass

(10) Patent No.: US 7,377,661 B2
(45) Date of Patent: May 27, 2008

(54) ILLUMINATED SINK

(75) Inventor: John Michael Douglass, Algonquin, IL (US)

(73) Assignee: Elkay Manufacturing Company, Oak Brook, IL (US)

( * ) Notice: Subject to any disclaimer, the term of this patent is extended or adjusted under 35 U.S.C. 154(b) by 50 days.

(21) Appl. No.: 11/305,079

(22) Filed: Dec. 16, 2005

(65) Prior Publication Data

US 2006/0133065 A1 Jun. 22, 2006

Related U.S. Application Data

(60) Provisional application No. 60/636,749, filed on Dec. 16, 2004.

(51) Int. Cl.
*F21V 33/00* (2006.01)

(52) U.S. Cl. ..... 362/101; 4/632; 4/633; 4/634; 312/140.1; 312/228

(58) Field of Classification Search ..... 362/96, 362/101, 410, 145, 153; 312/140.1, 140.2, 312/140.3, 140.4, 228; 4/631–636, 661
See application file for complete search history.

(56) References Cited

U.S. PATENT DOCUMENTS

| | | | | |
|---|---|---|---|---|
| 189,844 | A | 4/1877 | Cloke | |
| 2,460,543 | A | 2/1949 | Spierer | |
| 3,982,288 | A | 9/1976 | Borne | |
| 4,150,472 | A | 4/1979 | Derain | |
| 4,911,492 | A | 3/1990 | Ward | |
| 5,123,130 | A | 6/1992 | Sanders | |
| 5,263,209 | A | 11/1993 | Pattee | |
| 5,505,419 | A | 4/1996 | Gabrius | |
| 5,611,089 | A | 3/1997 | Cretors | |
| 5,743,501 | A | 4/1998 | Rapp | |
| 5,799,124 | A * | 8/1998 | Zorn et al. | 385/125 |
| 5,813,063 | A | 9/1998 | Watkins et al. | |
| 6,279,180 | B1 | 8/2001 | Bell et al. | |
| 6,539,561 | B2 | 4/2003 | Shimizu | |
| 6,886,958 | B1 * | 5/2005 | Grant | 362/101 |
| 2005/0050629 | A1 * | 3/2005 | Brown | 4/631 |

FOREIGN PATENT DOCUMENTS

JP 2001112855 A * 4/2001

* cited by examiner

*Primary Examiner*—Sharon E. Payne
*Assistant Examiner*—Mary Zettl
(74) *Attorney, Agent, or Firm*—Leydig, Voit & Mayer, Ltd.

(57) ABSTRACT

The invention provides a method and arrangement for illuminating an under mount sink disposed subjacent a counter. A light source is disposed below a top surface of the counter and proximate to the under mount sink. The under mount sink is affixed to the underside of the counter and power is supplied to the light source. The under mount sink is illuminated by the light source when the power source is activated. The invention also provides a device that may be used for illuminating an under mount sink, while keeping the light source from contact with water.

25 Claims, 17 Drawing Sheets

ILLUMINATED SINK

CROSS-REFERENCE TO RELATED APPLICATIONS

This patent application claims the benefit of U.S. Provisional Patent Application No. 60/636,749, filed Dec. 16, 2004.

FIELD OF THE INVENTION

This invention is directed to under mount sinks, and, more particularly, to illuminate under mount sinks and methods of illuminating under mount sinks.

BACKGROUND OF THE INVENTION

Under mount sinks are mounted below a surface, such as counter, as opposed to sinks that are mounted above a counter or molded as a single piece with the counter. Illumination in the vicinity of such sinks is usually provided by one or more light fixtures present to illuminate the entire room, or task lighting that specifically illuminates the vicinity of the sink. While task lighting disposed near the ceiling above the sink provides slightly more direct light while performing actions such as washing dishes, shaving, brushing teeth, etc., such lighting may be easily obstructed by the user positioning himself between the light fixture and the sink. Additionally, light projected from above the sink can be undesirably bright and intrusive when all that is needed is enough light to serve as decoration, a nightlight, or to help a user find the sink in the dark. Both general and task lighting are not typically disposed to project directly into and illuminate the sidewalls and base of an under mount sink basin.

The invention provides such a method, arrangement, and device to project light directly into an under mount sink to illuminate the sink basin. These and other advantages of the invention, as well as additional inventive features, will be apparent from the description of the invention provided herein.

BRIEF SUMMARY OF THE INVENTION

The invention provides a method of illuminating an under mount sink having an upwardly opening end disposed subjacent a counter. A light source is disposed below a top surface of the counter and proximate to the upwardly opening end of the under mount sink. The under mount sink is affixed to the underside of the counter and power is supplied to the light source. The under mount sink is illuminated by the light source when the power source is activated.

The invention also provides an illuminated under mount sink arrangement for placement subjacent a counter having a top surface, and for connection to a power supply. The arrangement comprises an under mount sink defining a bowl having an upwardly opening end, and a light source placed below the top surface of the counter and proximate to the upwardly opening end of the under mount sink, the light source being connected to the power supply. The light source illuminates the under mount sink when the power supply is activated.

The invention also provides a device for connection to a power source and for illuminating an under mount sink when disposed subjacent a top surface of a counter. The under mount sink comprises an open bowl having an upwardly opening end. The device comprises a light source adapted to selectively emit light, and a body made of a translucent material. The body further comprises a first mounting surface whereby the body is adapted to be disposed below the top surface of the counter, a light receiving surface adapted for receiving light from the light source, and a light exposing surface adapted for exposing light into the under mount sink. When the first mounting surface of the body is placed below the top surface of the counter and a light source is disposed near the light receiving surface, light from the light source travels through the body and exits from the light exposing surface to provide illumination to the upwardly opening end of the under mount sink.

DETAILED DESCRIPTION OF THE INVENTION

Figure 1:
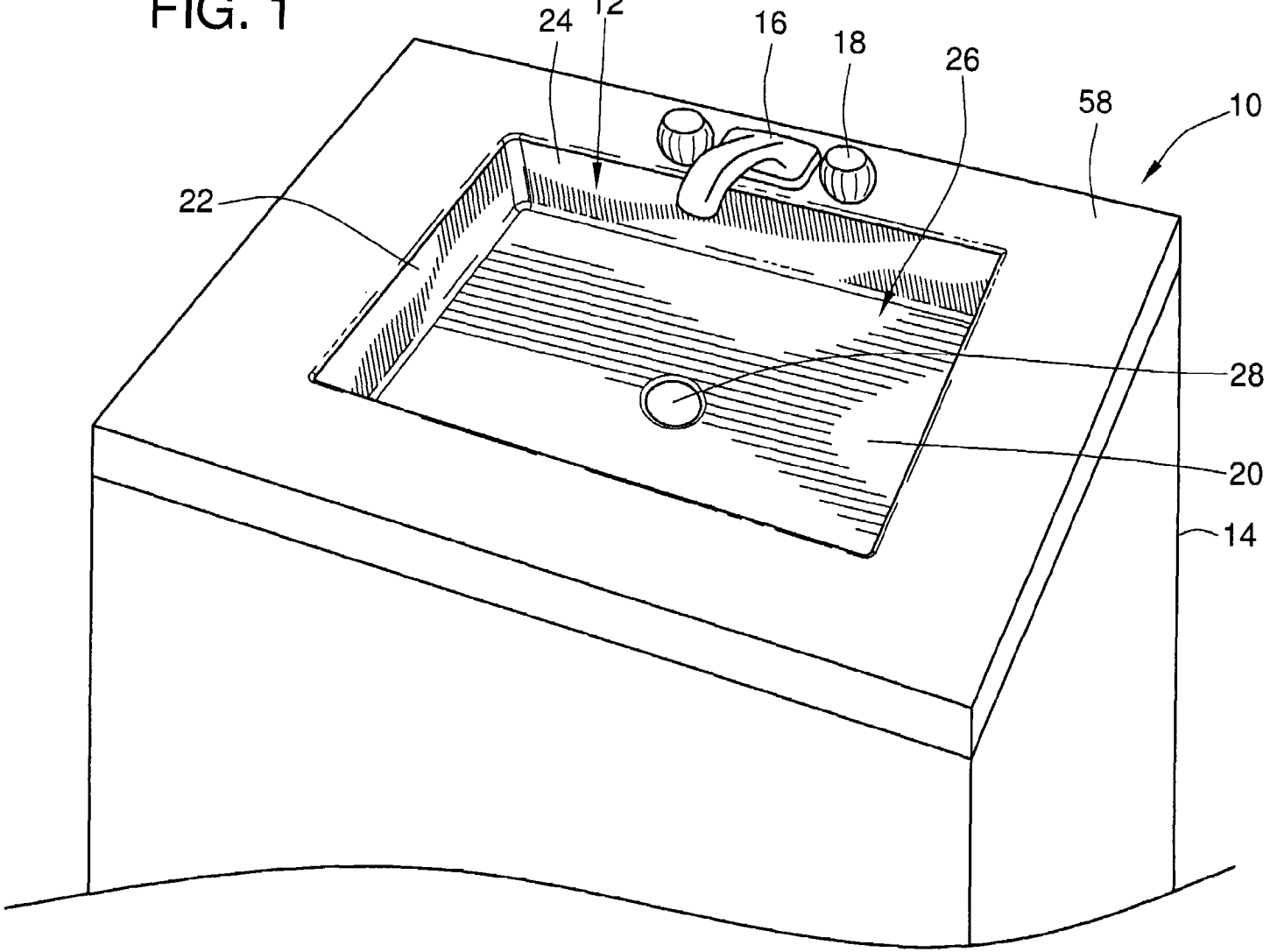
FIG. 1 is a perspective view from above of an under mount sink attached to a counter.

Turning now to the drawings, there is shown in FIG. 1, a counter 10 with an under mount sink 12. The counter 10 is mounted on a base 14, which is often functional as a cabinet for storage. The counter 10 may be constructed of any material known in the art including but not limited to, corian or other manmade acrylic and/or polyester plastics, manmade quartz based surfaces, granite, marble, or steel. Although the embodiment illustrated shows a faucet 16 to supply water into the interior or sink basin 26 of the sink 12 mounted to the counter surrounding the sink, it will be appreciated that the faucet 16 could be otherwise mounted, such as to a wall proximate the sink. The faucet 16 may have one or more handles 18 separate from or incorporated as part of the faucet 16 to control water temperature and/or water flow rate.

Figure 2:
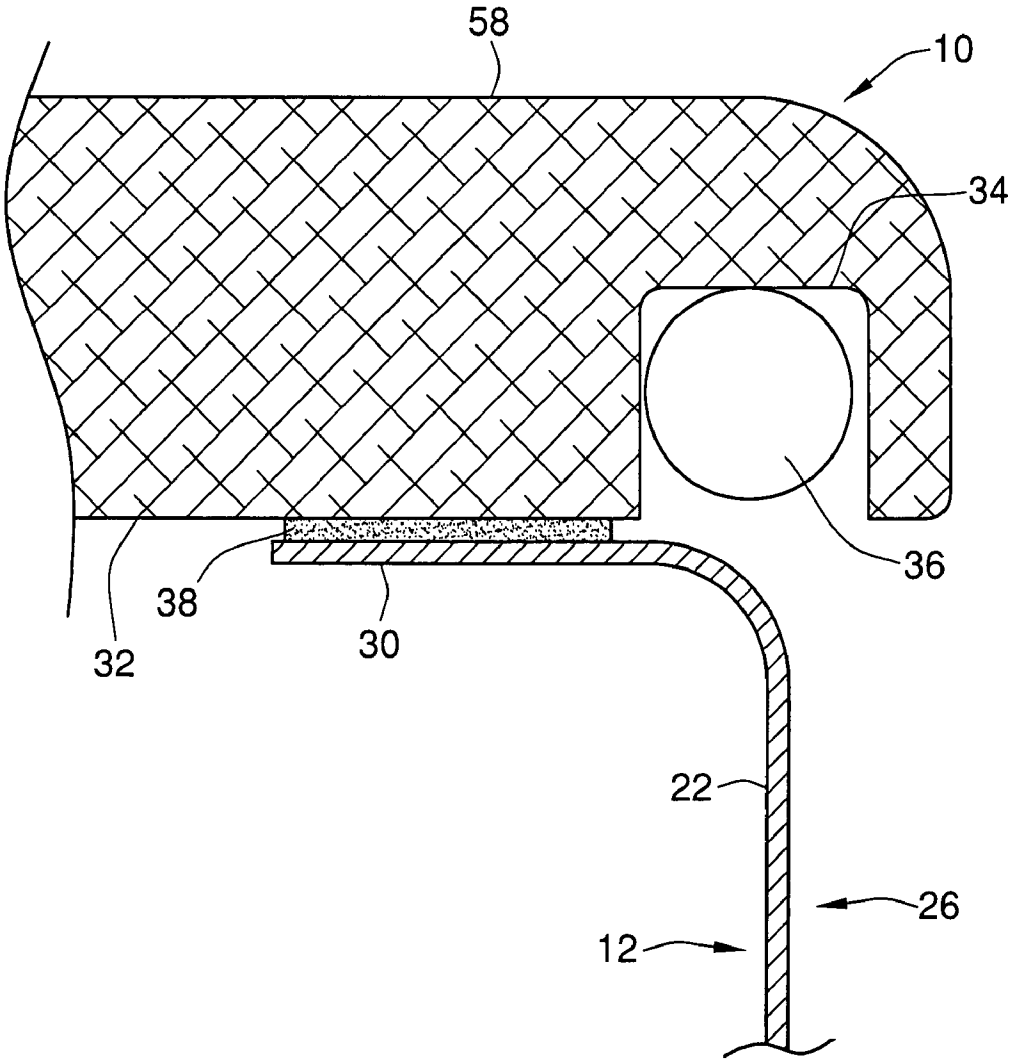
FIG. 2 is a fragmentary side cross-sectional view of an illuminated sink arrangement constructed in accordance with teachings of the invention.

The sink 12 depicted in FIG. 1 is shown for illustration purposes and those of skill in the art would recognize that the invention is applicable to any and all shapes of under mount sinks. The under mount sink 12 has a base 20 and a plurality of sidewalls, such as 22, 24 to form the sink basin 26. The under mount sink 12 has a drain 28 in the base 20 for the removal of water from the sink 12. Referring to FIG. 2, the under mount sink 12 also has an upper flange 30 extending from the sidewall 22 along the perimeter of the sink basin 26. The under mount sink 12 may be constructed of any material known in the art including, acrylic, porcelain, stainless steel, copper, brass, etc.

Figure 17:
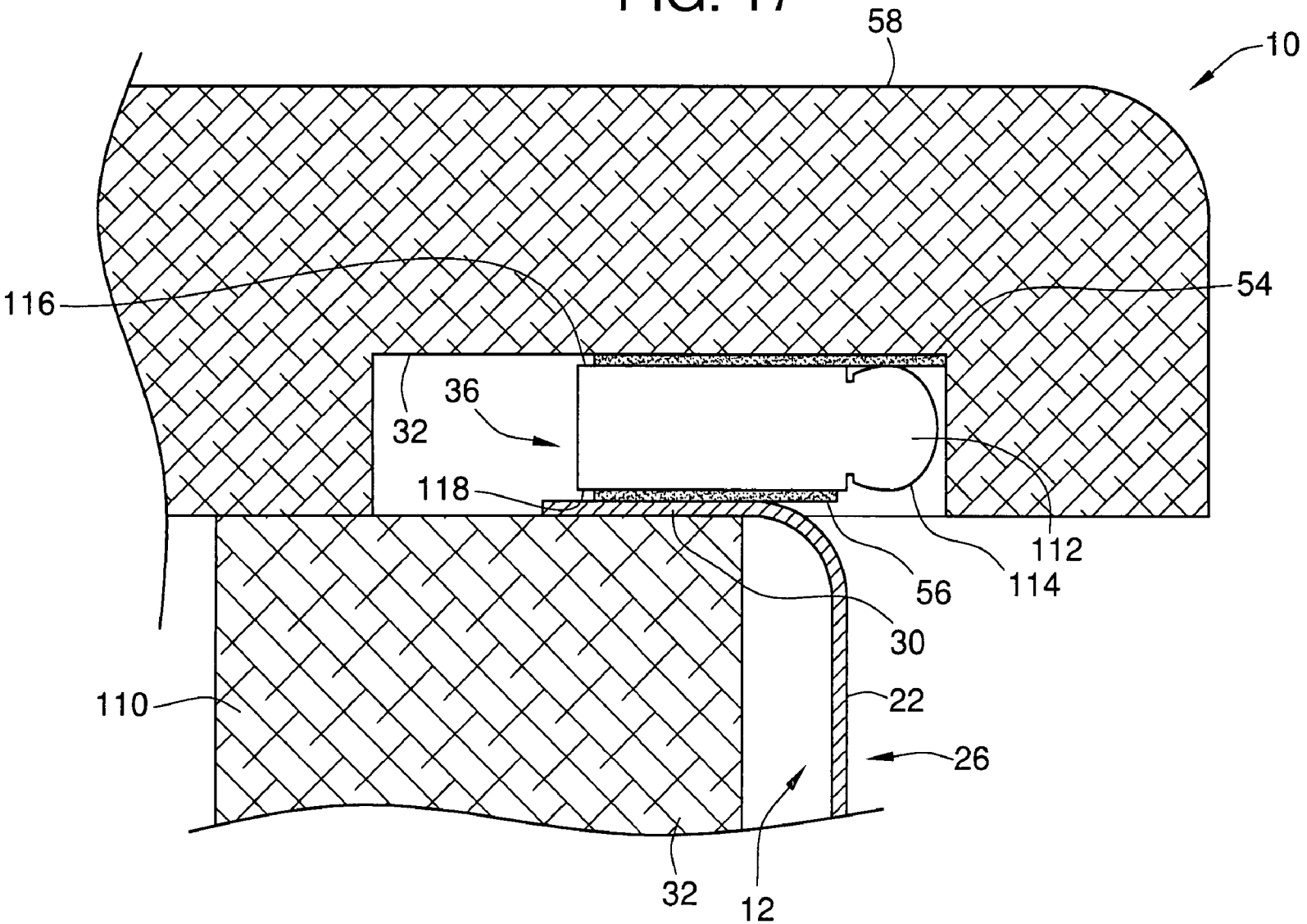
FIG. 17 is a fragmentary side cross-sectional view of an eleventh embodiment of an illuminated sink arrangement constructed in accordance with teachings of the invention.

When coupled to the counter 10, the upper flange 30 is disposed adjacent to the underside 32 of the counter 10 for mounting the under mount sink 12, as opposed to conventional sinks wherein the upper flange would be disposed along a top surface of the counter. The under mount sink 12 may be attached to the counter 10 by any means known in the art. This includes but is not limited to the use of brackets, adhesives, bolts, or any combination thereof. Optionally, a sealant 38, such as caulk or putty may be used between the underside 32 of the counter 10 and the upper flange 30 of the under mount sink 12. In addition, a support frame 110, as shown in FIG. 17, may be used in coupling the under mount sink 12 to the counter 10.

Figure 3:
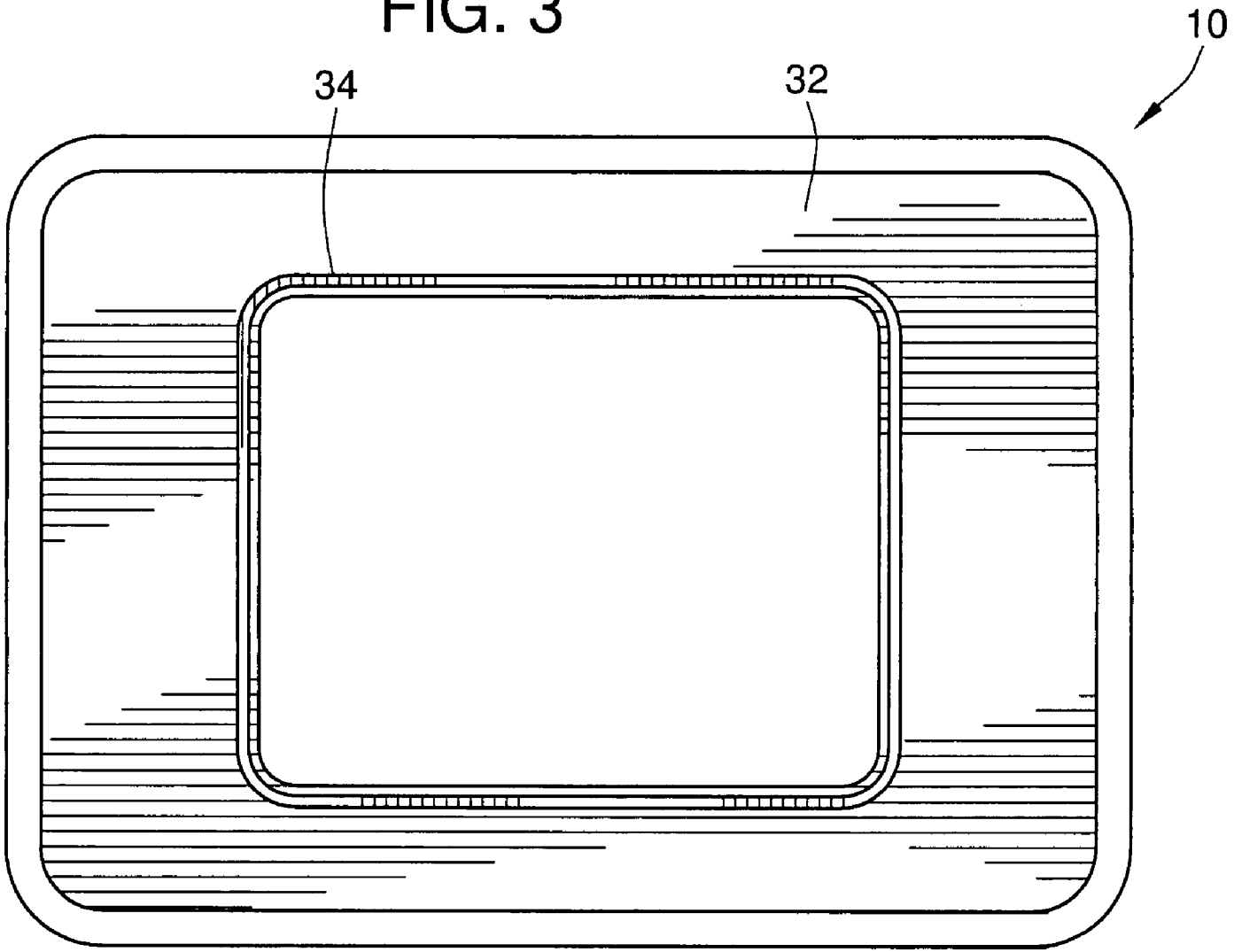
FIG. 3 is a plan view of the underside of a counter constructed in accordance with teachings of the invention.

In accordance with teachings of the invention, the sink 12 is provided with a lighting arrangement disposed generally adjacent at least a portion of the upper flange 30 such that it provides illumination to at least a portion of the sink 12. The lighting arrangement may be arranged and disposed in any appropriate manner to generally provide a light along at least a portion of the upper perimeter of the sink 12. For example, in order to generally conceal the light source 36 itself, yet provide illumination along at least a portion of the side walls 22 of the sink 12, a channel 34 may be provided or created in the underside 32 of the counter 10 to accommodate a light source 36 in a recessed position, as shown in FIG. 3. It will be appreciated by those of skill in the art that such a channel 34 may be formed in the underside 32 of the counter 10 during fabrication, or machined into the lower surface 32 following fabrication. Turning back to FIG. 2, the light source 36 is inserted into the channel 34 and is connected to a power source (not shown) to provide illumination along the side wall 22 and into the basin 26 of the sink 12.

The power source may be any source of power known in the art including, a battery or other DC power supply, or an AC power supply such as an electrical outlet in a home. The power source for the light source 36 may be adapted to turn on and off based on a user's selection or based upon changes in the environment, such as in response to a change in the lighting in the room.

Figure 4:
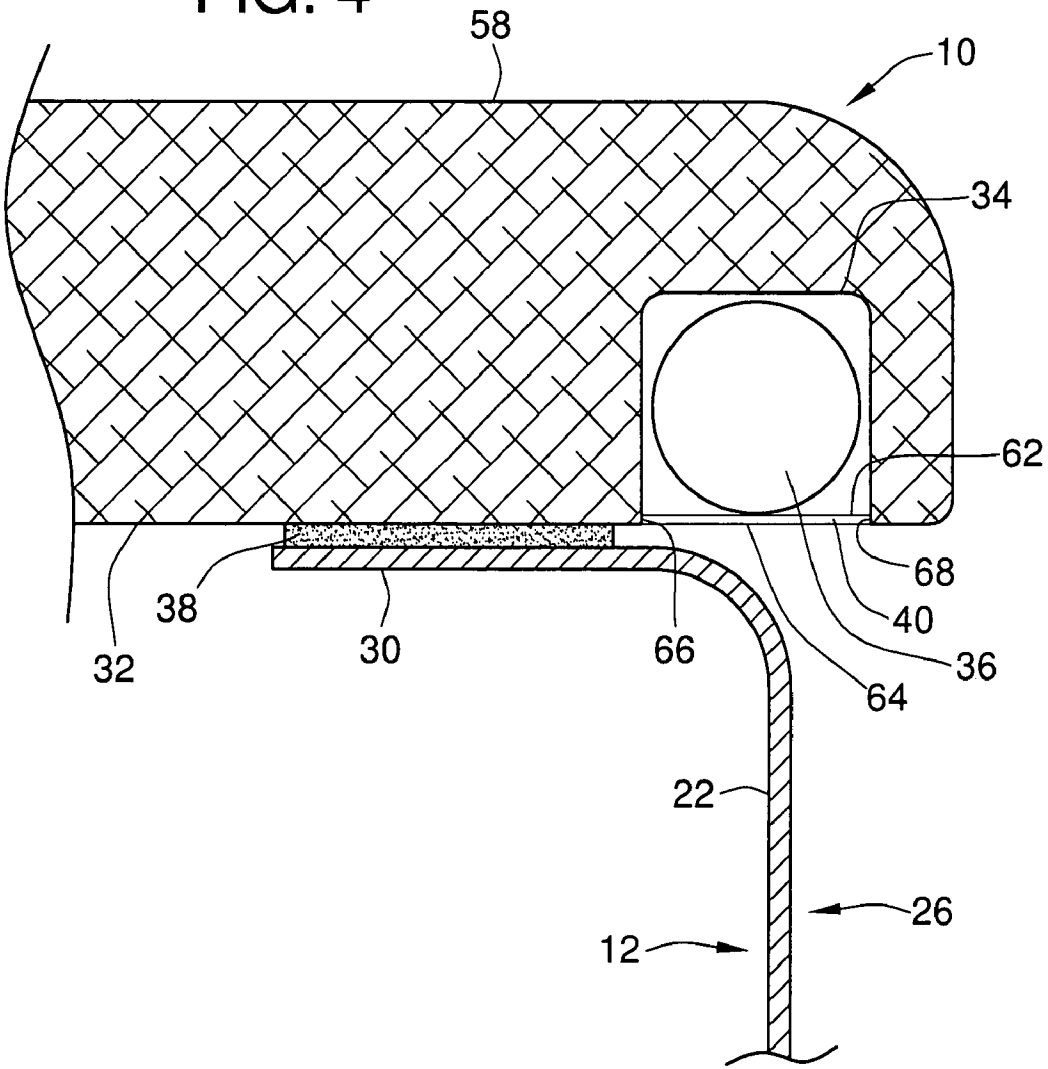
FIG. 4 is a fragmentary side cross-sectional view of a second embodiment of an illuminated sink arrangement constructed in accordance with teachings of the invention.

Due to the inherent dangers present when combining water with electrical devices, the light source 36 is preferably sealed and/or protected from contact with water by using a translucent sealant at the opening of the channel 34, such as caulk. Alternately, as shown in FIG. 4, a piece of translucent material in the form of a light guide 40, may be fitted into the channel 34 or placed over the opening of the channel 34 to prevent direct contact between the light source 36 and water. The light guide 40 has a body comprising a first mounting surface 66 for placement below the top surface 58 of the counter 10, a light receiving surface 62 for receiving light from the light source 36, and a light exposing surface 64 to expose light into the under mount sink 12. Optionally, a second mounting surface 68 may be used to secure the light guide 40 below the top surface 58 of the counter 10. While the light guide 40 is illustrated as disposed within the channel 34 opening, it will likewise be appreciated that light guide may be alternately disposed, yet still provide a sealing arrangement relative to the light source 36. For example, the light guide 40 may be secured to the lower surface 32 of the counter 10 itself, as opposed to being placed within the channel 34. The body may be constructed of any translucent material known in the art, including but not limited to glass, clear PVC, clear polycarbonate, cast acrylic, or cast polystyrene. This light guide 40 may be removable to allow access to the light source 36 for replacement or repair. Such caulk or light guide 40 promotes cleanliness and sanitary conditions in and around the sink 12 and counter 10.

Any letters used following a number to describe an element in the drawings is merely to reference the same element in different embodiments. Therefore, any statements made regarding an element in a drawing referred to by a number or a number followed by a letter may apply to any or all of the other embodiments with that numbered element shown or described, regardless of whether a letter is also present or not.

As shown in FIGS. 3 and 4, the channel 34 and the light source 36 may be positioned such that there is at least a slight overhang in the counter 10 above the sink basin 26. Accordingly, such overhang allows for the light source 36 to direct light substantially downward into the sink 12 to illuminate the sink basin 26. Meanwhile, the light source 36 is completely hidden from the view of the user of the sink 12 looking from above or from the side of the counter 10. This may be aesthetically pleasing to some users.

Figure 5:
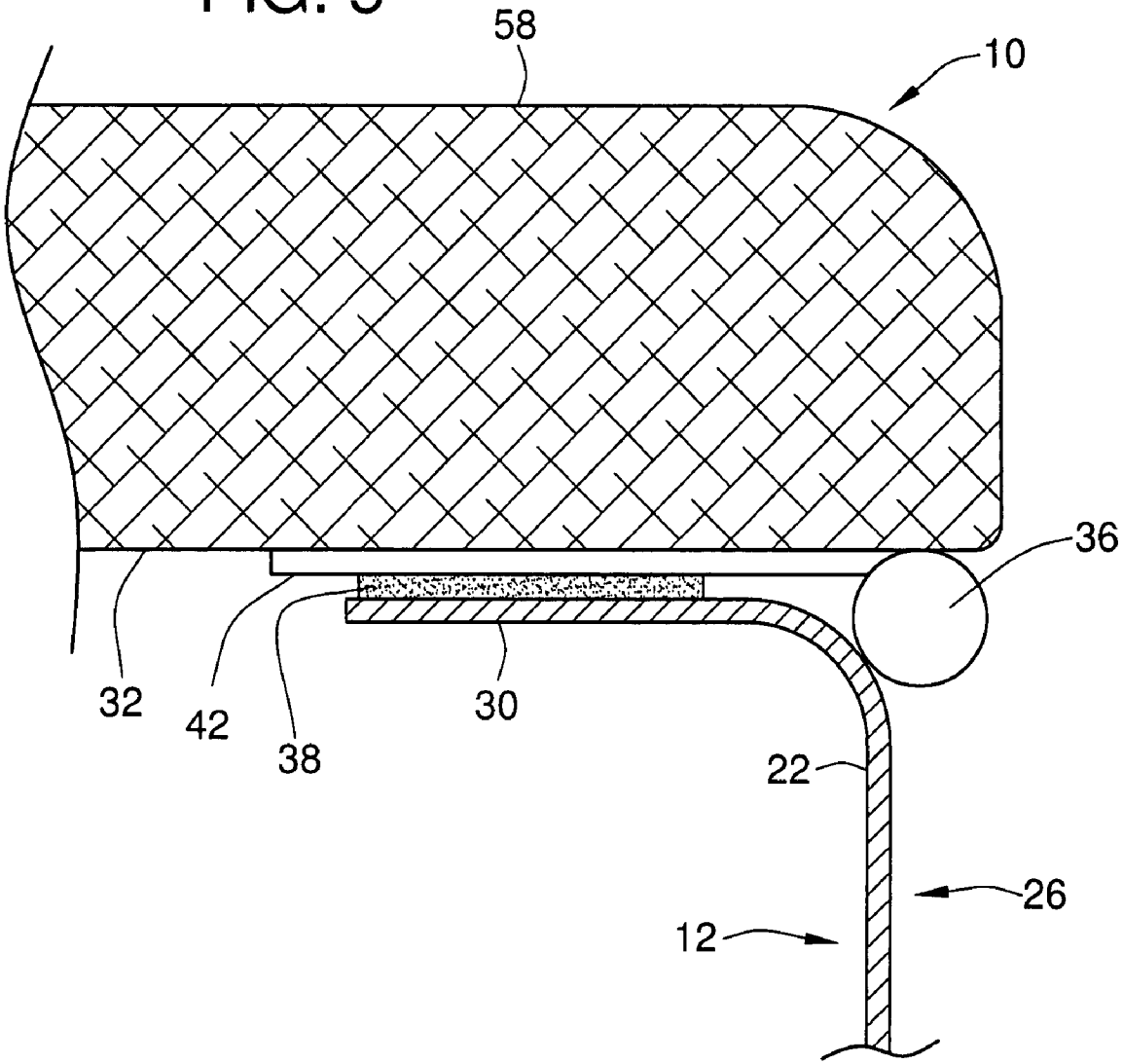
FIG. 5 is a fragmentary side cross-sectional view of a third embodiment of an illuminated sink arrangement constructed in accordance with teachings of the invention.

Although the light source 36 of FIGS. 3 and 4 is recessed into the underside of the counter 10 and not in direct contact with the sink 12 itself, the light source may be alternately disposed. In another embodiment, as shown in FIG. 5, the light source 36 is placed below the underside 32 of the counter 10 and proximate to the upper flange 30 and in contact with the sink basin 26. The light source 36 is held in place by any appropriate method, including, by way of example only, using cable ties 42. The cable ties 42 may be constructed of any material suitable for placement near a light source 36 and capable of retaining the light source 36 in place. Additionally, a translucent sealant, such as caulk, may be used to protect the light source 36 from contact with water. Once again, a sealant 38, such as caulk or putty may be used between the underside 32 of the counter 10 and the upper flange 30 of the under mount sink 12.

Alternately, the light source 36 may be disposed spaced from the open sink basin 26 and arranged such that the light from the light source 36 still illuminates the sink basin 26. This arrangement is particularly advantageous if a high voltage power source is attached to the light source 36 because it inhibits opportunities for moisture to contact with the light source 36. Additionally, such an arrangement potentially provides easier access to the light source 36 for repair and replacement. Further, such an arrangement may be utilized when it is undesirable or impracticable for the installer to create or manufacturer to provide a channel 34 in the underside 32 of the counter 10.

In order to allow such a placement of the light source 36 spaced from the open basin 26 of the sink 12, a light guide 44 is provided to project light from the light source 36 into the sink basin 26 inasmuch as the light source 36 itself does not project directly into the sink basin 26 due to its proximity. A number of embodiments illustrating such arrangements are depicted in FIGS. 6-14.

In a currently preferred embodiment, the light guide 44 has a body made of translucent material. The body may be constructed of any translucent material known in the art, including but not limited to glass, clear PVC, clear polycarbonate, cast acrylic, or cast polystyrene. The body has a first mounting surface 46 adapted for placement against the underside 32 of a counter 10, a second mounting surface 48 adapted for placement against the upper flange 30 of the under mount sink 12, a light receiving surface 50 adapted for receiving light from the light source 36, and a light exposing surface 52 adapted for exposing light into the under mount sink 12. Sealant 54, 56, such as caulk or putty, may be used between the body of the light guide 44 and the counter 10 and/or between the body of the light guide 44 and the upper flange 30 of the sink 12 to inhibit the advance of moisture between adjacent surfaces. Although the use of some type of sealant 54, 56 with the embodiments of the light guide 44 is preferable, it is not required.

Figure 6:
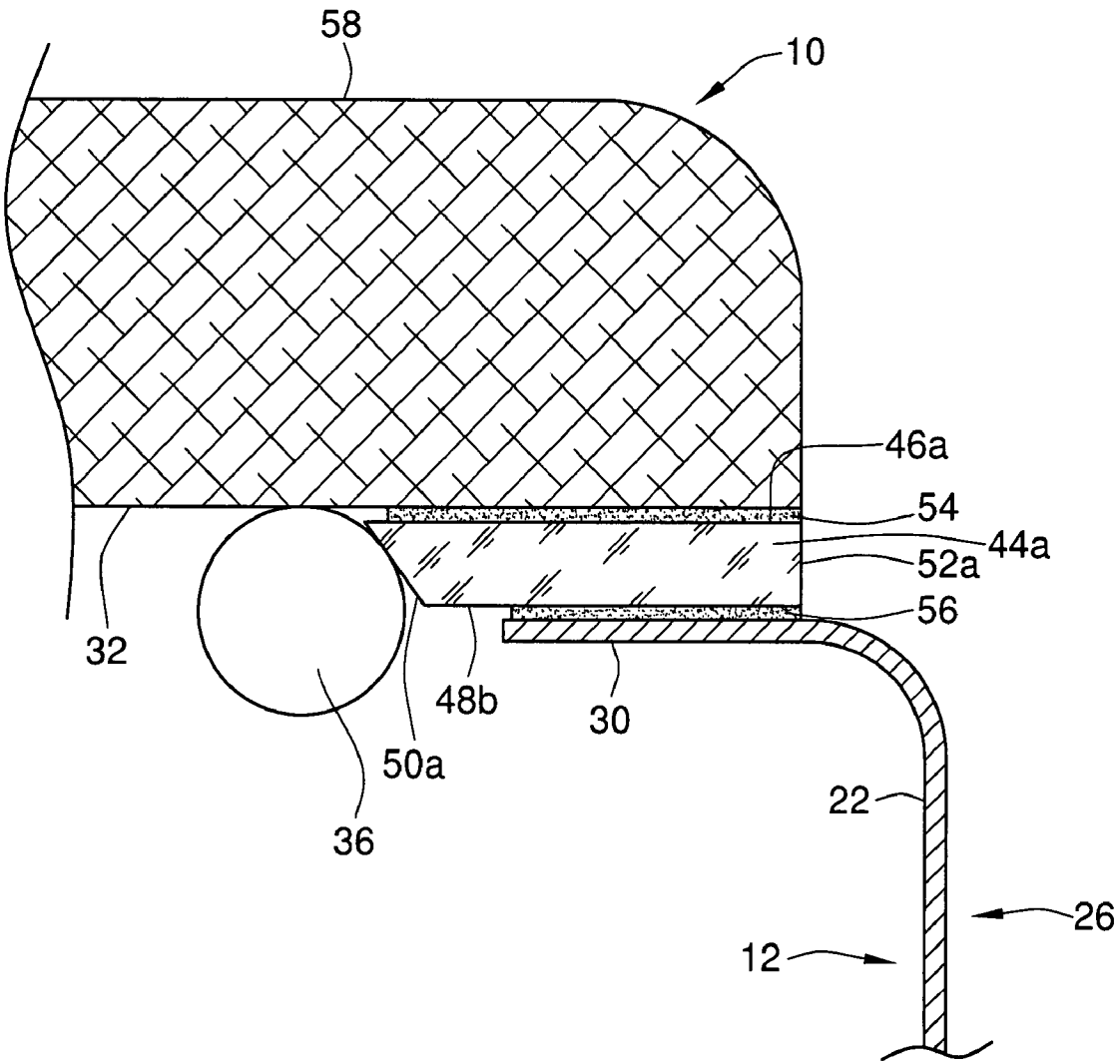
FIG. 6 is a fragmentary side cross-sectional view of a fourth embodiment of an illuminated sink arrangement constructed in accordance with teachings of the invention.

It will be appreciated by those of skill in the art that the light guide may be of any appropriate shape and the light guide and the light source may be disposed in any appropriate manner relative to the sink and counter such that the light from the light source is directed through the light guide into or along at least a portion of the sink basin 26. In one embodiment of the light guide 44*a*, as depicted in FIG. 6, the cross-section of the light guide 44*a* is quadrilateral-shaped. The light guide 44*a* is positioned below the top surface 58 of the counter 10 and above the upper flange 30 of the under mount sink 12. The light source 36 is mounted below the top surface 58 of the counter 10 and placed proximate to the light receiving surface 50*a* of the light guide 44*a*. The light exposing surface 52*a* of the light guide 44*a* faces the interior of the sink 12. When a power source (not shown), connected to the light source 36 is activated, the light source 36 transmits light into the light receiving surface 50*a* of the light guide 44*a*. The light travels through the light guide 44*a* and exits through the light exposing surface 52*a* to cast light into or along at least a portion of the sink basin 26. A sealant 54, 56 may be placed between the first mounting surface 46*a* and the underside 32 of the counter 10 and/or between the second mounting surface 48*b* and the upper flange 30 of the under mount sink 12. In this embodiment, the light guide 44*a* is exposed to the user.

Figure 7:
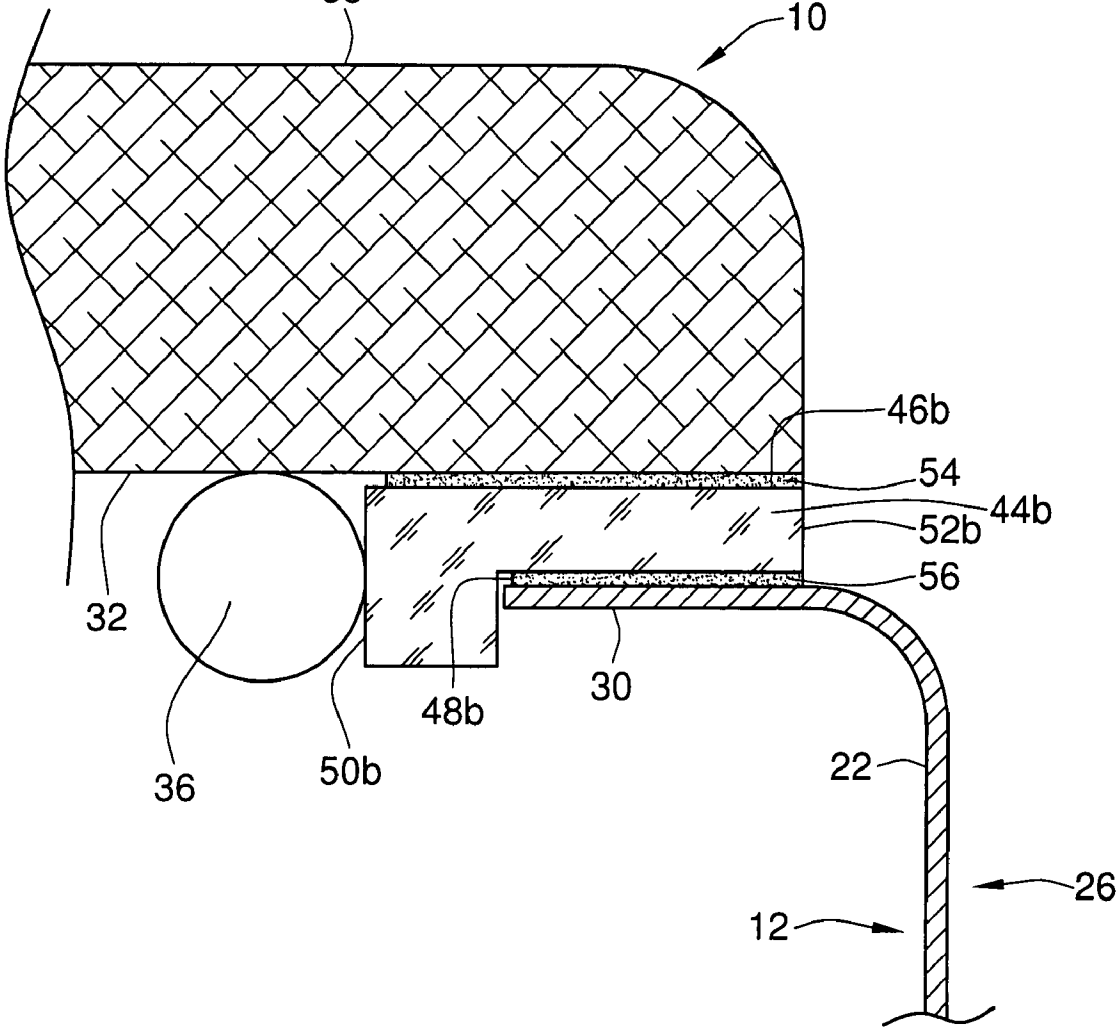
FIG. 7 is a fragmentary side cross-sectional view of a fifth embodiment of an illuminated sink arrangement constructed in accordance with teachings of the invention.

In another embodiment of the light guide 44*b*, as depicted in FIG. 7, the light guide 44*b* has an L-shaped cross-section. This embodiment is positioned similarly to the previous embodiment, with the first mounting surface 46*b* adapted for placement against the underside 32 of the counter 10 and the second mounting surface 48*b* adapted for placement against the upper flange 30 of the under mount sink 12. The light exposing surface 52*b* is viewable by the user. Once again, a sealant 54, 56 may be placed between the first mounting surface 46*b* and the underside 32 of the counter 10 and/or between the second mounting surface 48*b* and the upper flange 30 of the under mount sink 12. The L-shape provides a large surface area at the light receiving surface 50*b* to capture and guide light from the light source 36 into the under mount sink 12.

Figure 8:
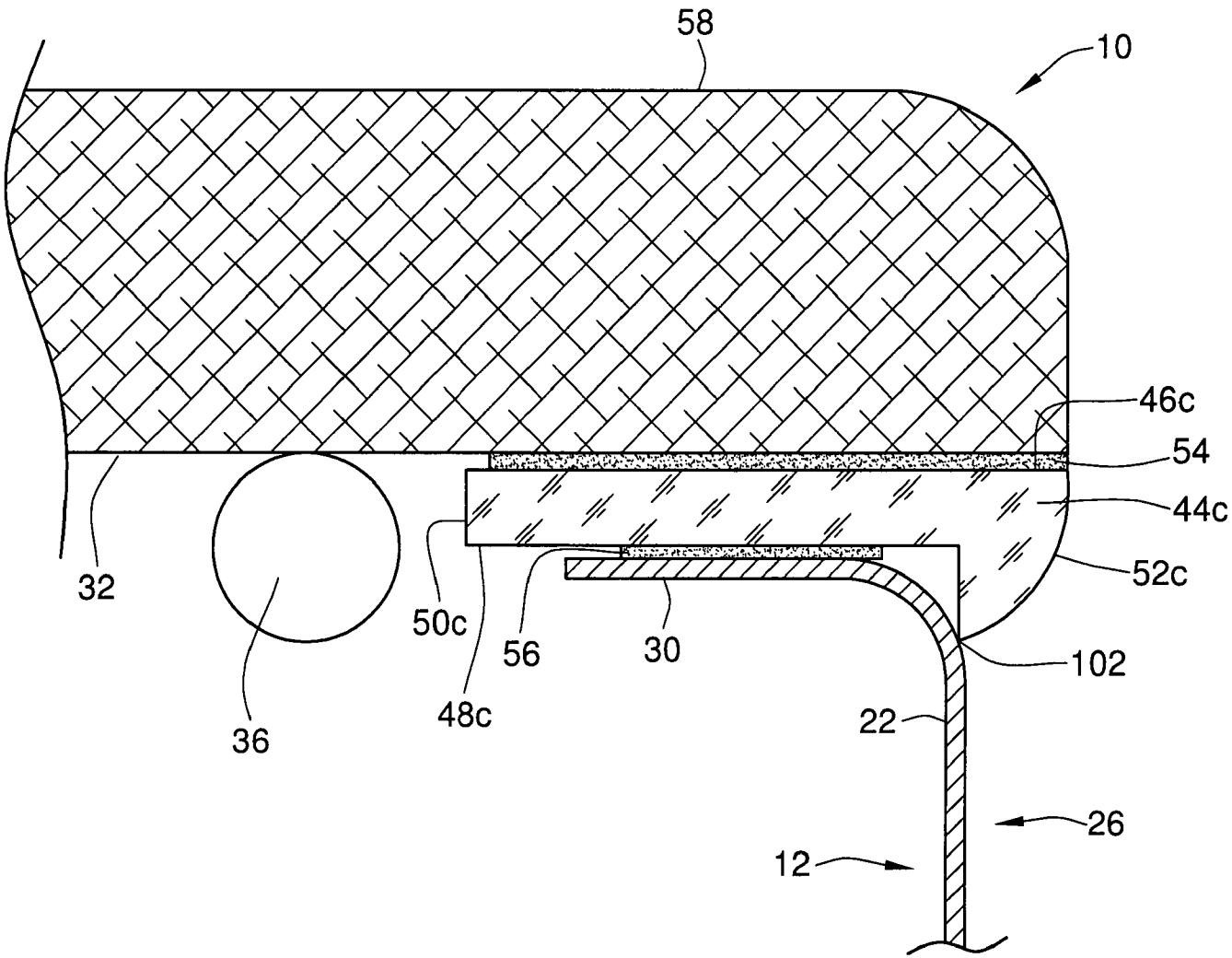
FIG. 8 is a fragmentary side cross-sectional view of a sixth embodiment of an illuminated sink arrangement constructed in accordance with teachings of the invention.

In another embodiment of the light guide 44*c*, as depicted in FIG. 8, the light guide 44*c* has an approximately L-shaped cross-section except that the base of the L-shape, the light exposing surface 52*c*, has a curved cross-section. In this embodiment, the first mounting surface 46*c* is adapted for placement against the underside 32 of the counter 10 and the second mounting surface 48*c* is adapted for placement against the upper flange 30 of the under mount sink 12. The light receiving surface 50*c* is near the light source 36, and the light exposing surface 52*c* is positioned to face the sink basin 26. Once again, a sealant 54, 56 may be placed between the first mounting surface 46*c* and the underside 32 of the counter 10 and/or between the second mounting surface 48*c* and the upper flange 30 of the under mount sink 12. Sealant may also optionally be placed at the point of contact 102 between the light guide 44*c* and the sink basin 26. The curved shape of the light exposing surface 52*c* aids in the transmission of the light substantially downward into the sink basin 26. Similar to the previous two embodiments, this embodiment of the light guide 44*c* is exposed to the user.

Figure 9:
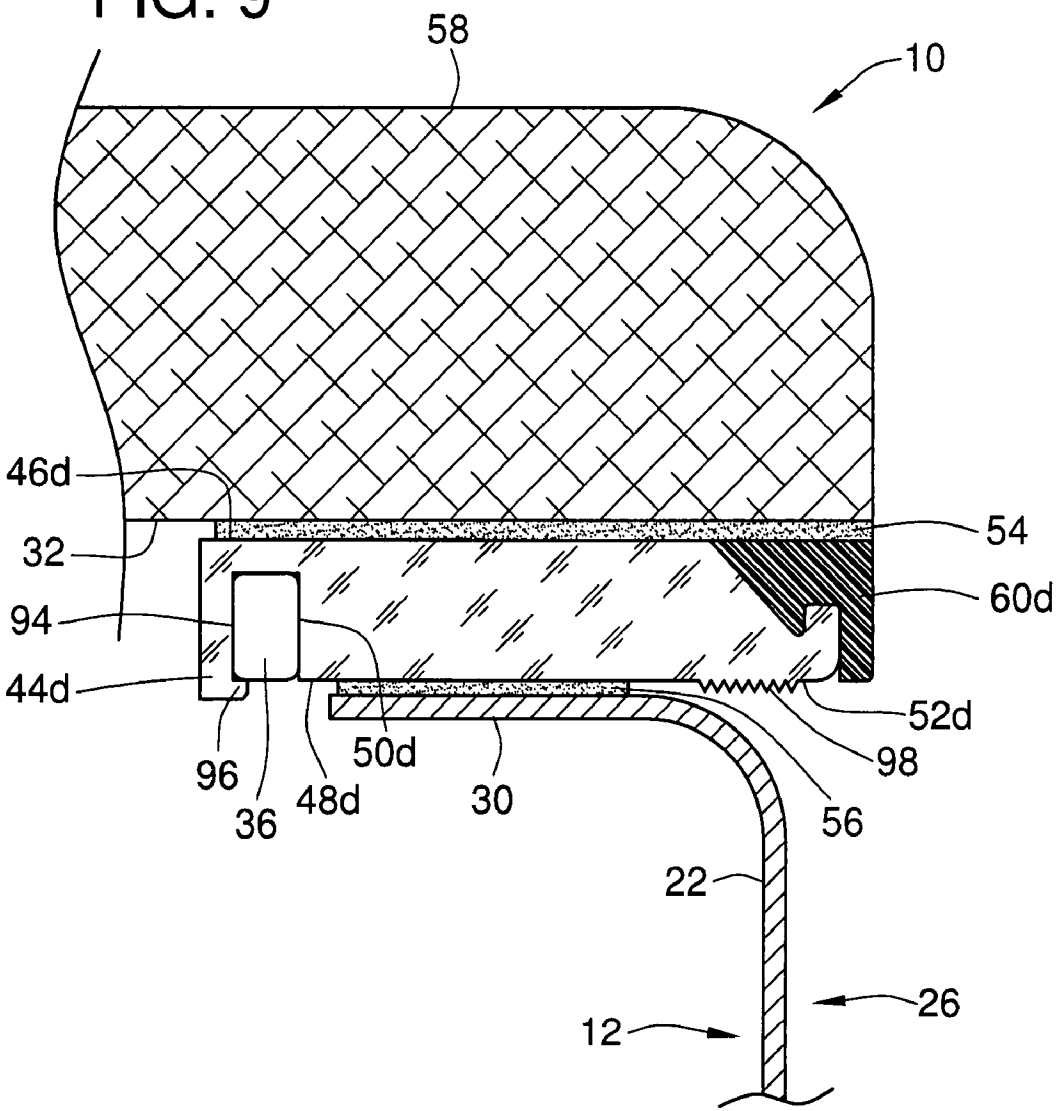
FIG. 9 is a fragmentary side cross-sectional view of a seventh embodiment of an illuminated sink arrangement constructed in accordance with teachings of the invention.

Some users may find that it is more aesthetically appealing to conceal the light guide 44*d* from view, however, and/or have the light exit substantially downward into the basin 26 of the sink 12. In yet another embodiment, as depicted in FIG. 9, an opaque light shield 60*d* is attached to the light guide 44*d* to conceal the light guide 44*d* from the user. In this embodiment, the first mounting surface 46*d* is adapted for placement against the underside 32 of the counter 10 and the second mounting surface 48*d* is adapted for placement against the upper flange 30 of the under mount sink 12. The light receiving surface 50*d* is near the light source 36, and the light exposing surface 52*d* lies contiguously in the same plane as the second mounting surface 48*d* to direct the light substantially downward into the sink basin 26. Once again, a sealant 54, 56 may be placed between the first mounting surface 46*d* and the underside 32 of the counter 10 and/or between the second mounting surface 48*d* and the upper flange 30 of the under mount sink 12. The opaque light shield 60*d* may be chosen from a variety of colors including colors to match the under mount sink 12, counter 10, design scheme of the room, etc. The opaque light shield 60*d* may be adapted to securely attach to the light guide 44*d* as shown in FIG. 9. In this embodiment, the compression force between the counter 10 and the upper flange 30 of the under mount sink 12 along with the shape of the opaque light shield 60*d* will hold the opaque light shield 60*d* in place.

Figure 10:
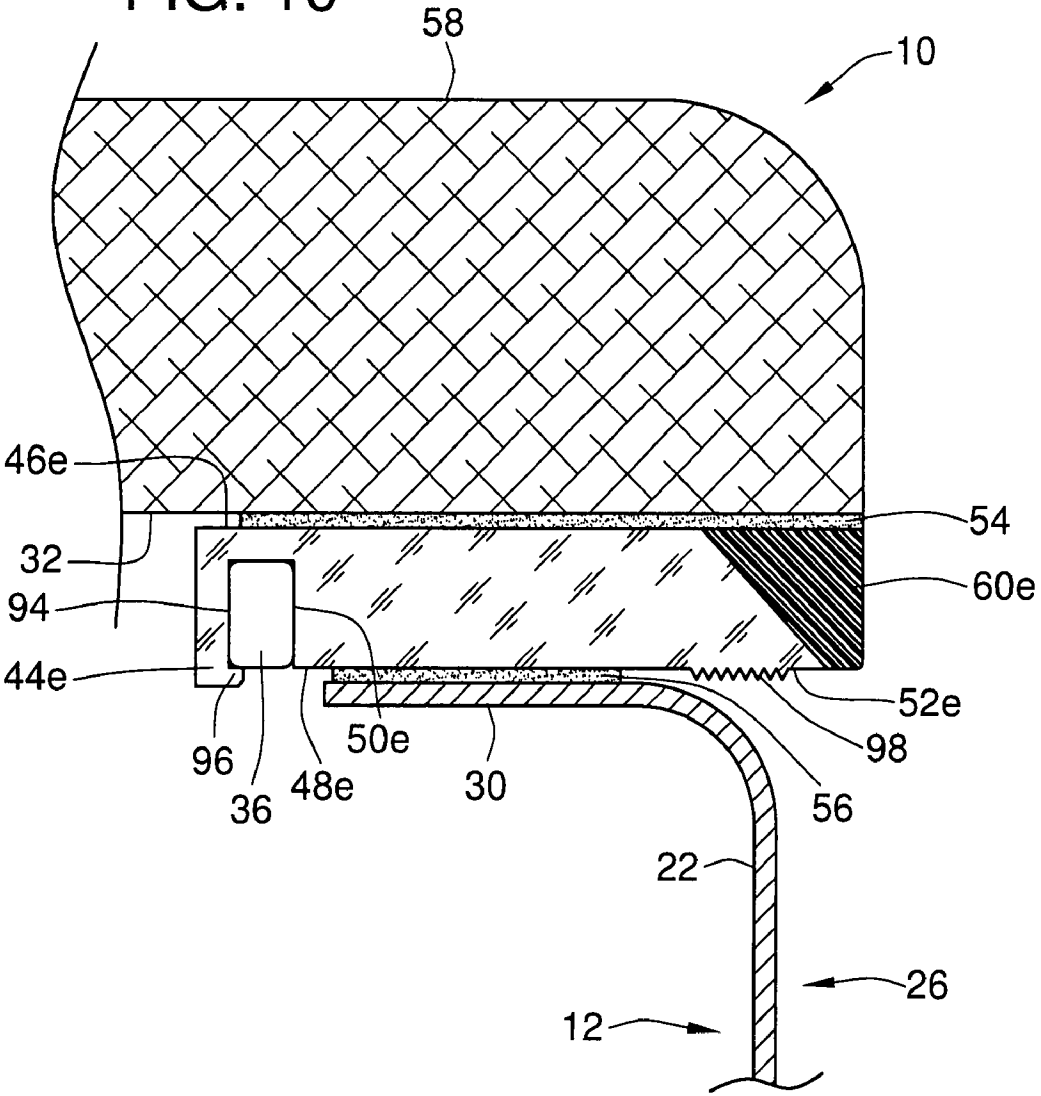
FIG. 10 is a fragmentary side cross-sectional view of an eighth embodiment of an illuminated sink arrangement constructed in accordance with teachings of the invention.
Figure 11:
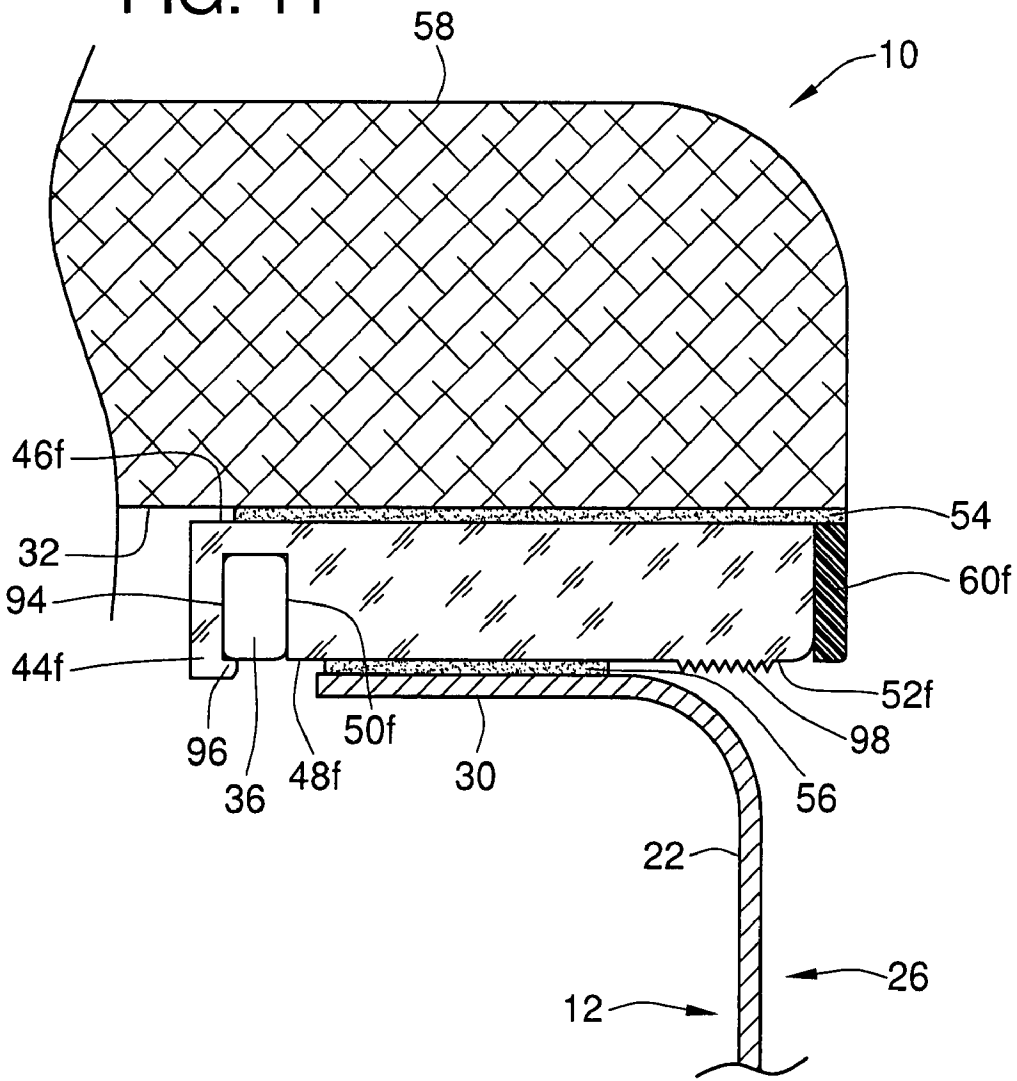
FIG. 11 is a fragmentary side cross-sectional view of a ninth embodiment of an illuminated sink arrangement constructed in accordance with teachings of the invention.

The opaque light shield 60*e* may also be constructed with an alternate shape, such as, for example, an angled surface, as shown in FIG. 10, such that it increases the intensity of the light exiting the light guide 44*e* by deflecting light substantially downward toward the light exposing surface 52*e*. The opaque light shield 60*f* may also be a strip of material attached to the light guide 44*f* as shown in FIG. 11. Optionally, materials with adhesive properties may be used to attach the opaque light shield 60 to the light guide 44 or the opaque light shield 60 may be created as a single unit with the light guide 44. The opaque light shield 60*f* may alternately be an opaque paint, caulk, or other coating material disposed along the light guide sufficient to hide the translucent light guide 44*f* from view.

Figure 12:
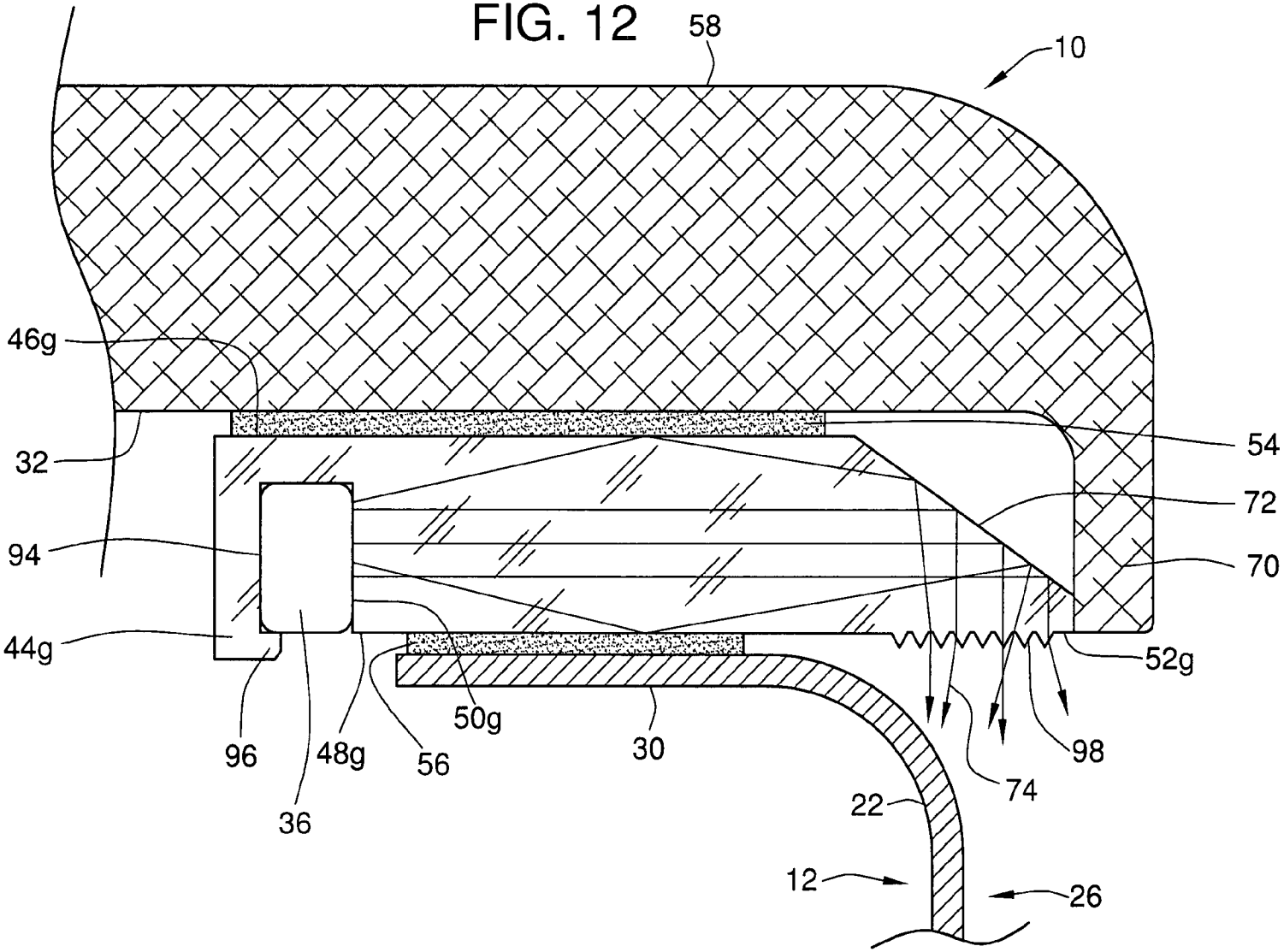
FIG. 12 is a fragmentary side cross-sectional view of a tenth embodiment of an illuminated sink arrangement constructed in accordance with teachings of the invention.

Alternately, the counter 10 itself may be utilized to shield the light source 36 from view. In another embodiment, as shown in FIG. 12, an opaque light shield 60 is not needed to hide the light guide 44*g* from view because the counter 10 has been adapted or created with a downward vertical edge 70. In this case, the vertical edge 70 hides the light guide 44*g* from view and the light emitted from the light guide 44*g* is directed substantially downward. In this embodiment, the first mounting surface 46*g* is adapted for placement against the underside 32 of the counter 10 and the second mounting surface 48*g* is adapted for placement against the upper flange 30 of the under mount sink 12. The light receiving surface 50*g* is near the light source 36, and the light exposing surface 52*g* lies contiguously in the same plane as the second mounting surface 48*g* to direct the light substantially downward into the sink basin 26. Once again, a sealant 54, 56 may optionally be placed between the first mounting surface 46*g* and the underside 32 of the counter 10 and/or between the second mounting surface 48*g* and the upper flange 30 of the under mount sink 12. To further facilitate the movement of light substantially downward into the sink basin 26, a surface 72 of the light guide 44*g* may be angled downward. Light transmissions 74 are depicted in FIG. 12 to show some potential paths of light when the light source 36 is provided power by a power source (not shown).

In another embodiment, as shown in FIG. 17, the light source 36 has a light emitting portion 112 with a light exposing surface 114 disposed to emit light directly into the sink basin 26. As shown, the light exposing surface 114 may have a curvature. In this embodiment, the first mounting surface 116 of the light source 36 is adapted for placement against the underside 32 of the counter 10 and the second mounting surface 118 of the light source 36 is adapted for placement against the upper flange 30 of the under mount sink 12. The light exposing surface 114 is positioned relative to the counter 10 to direct light downward into the sink basin 26. A sealant 54, 56 may be placed between the first mounting surface 116 and the underside 32 of the counter 10 and/or between the second mounting surface 118 and the upper flange 30 of the under mount sink 12. By way of example and not limitation, an example of a suitable light source that may be used in this embodiment is an LED light strip. An optional support frame 110 may be provided to aid in coupling the sink 12 and light source 36 to the counter 10. It will be appreciated that any suitable support frame may be used.

Figure 13:
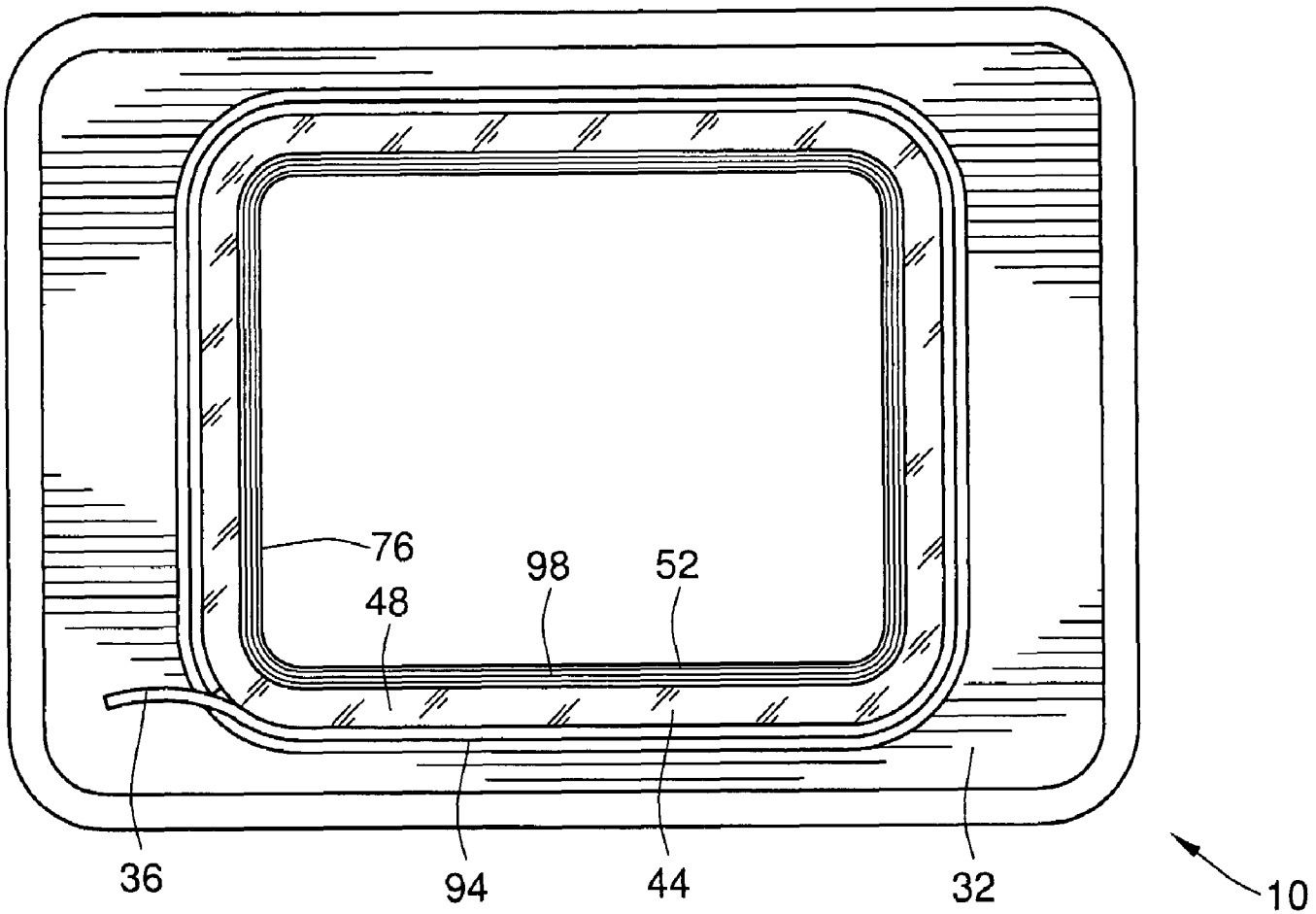
FIG. 13 is a plan view of the underside of a counter with a light guide constructed in accordance with teachings of the invention.
Figure 14:
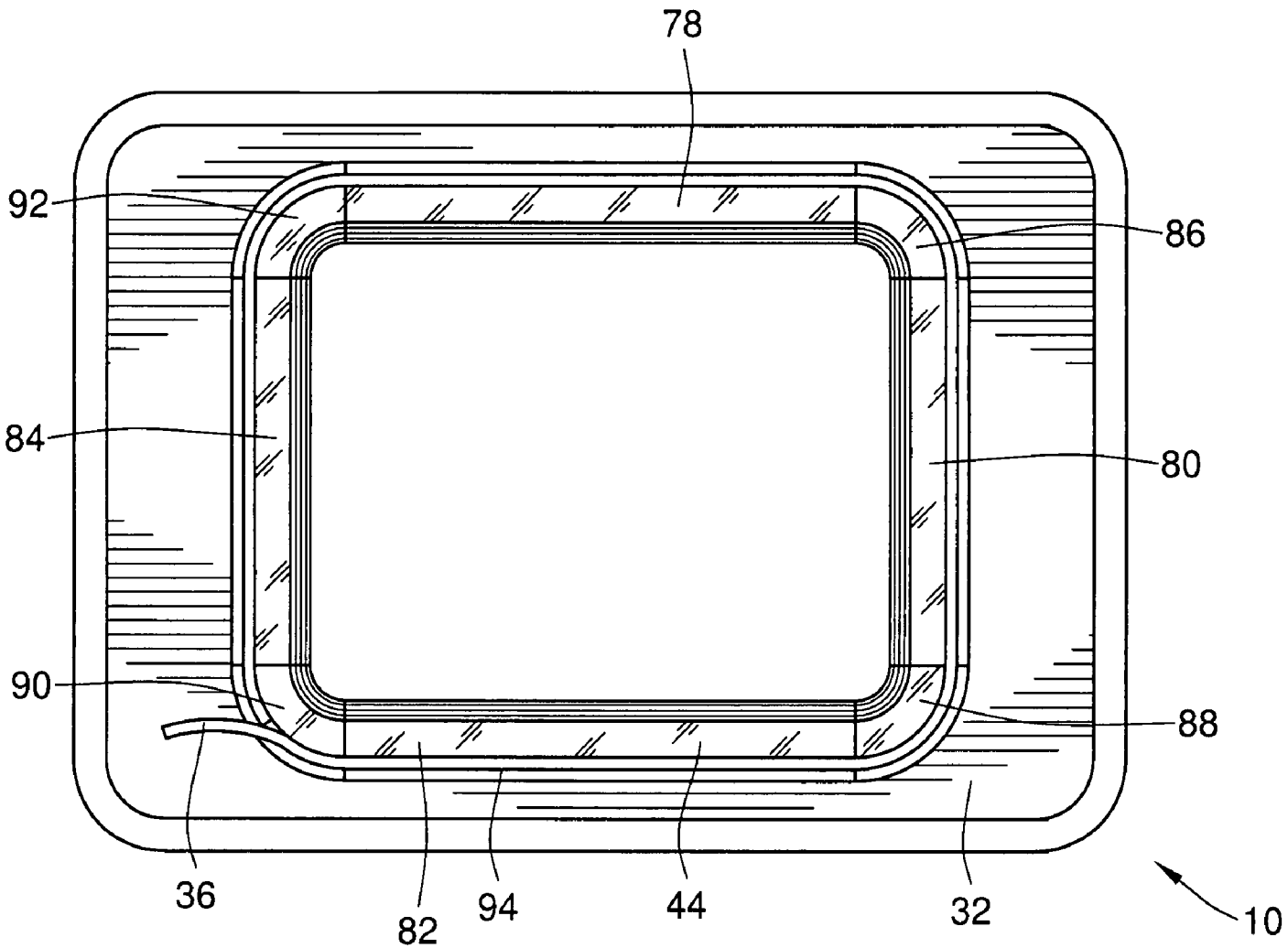
FIG. 14 is a plan view of the underside of an alternate arrangement of a counter with a light guide constructed in accordance with teachings of the invention.

Turning to FIG. 13, the light guide 44 may be manufactured as a single piece to entirely surround the perimeter of the counter opening 76, or it may include a plurality of segments. For example, as shown in FIG. 14, the light guide 44 may be provided in separate pieces including side pieces 78, 80, 82, 84 and corner pieces 86, 88, 90, 92.

Figure 15:
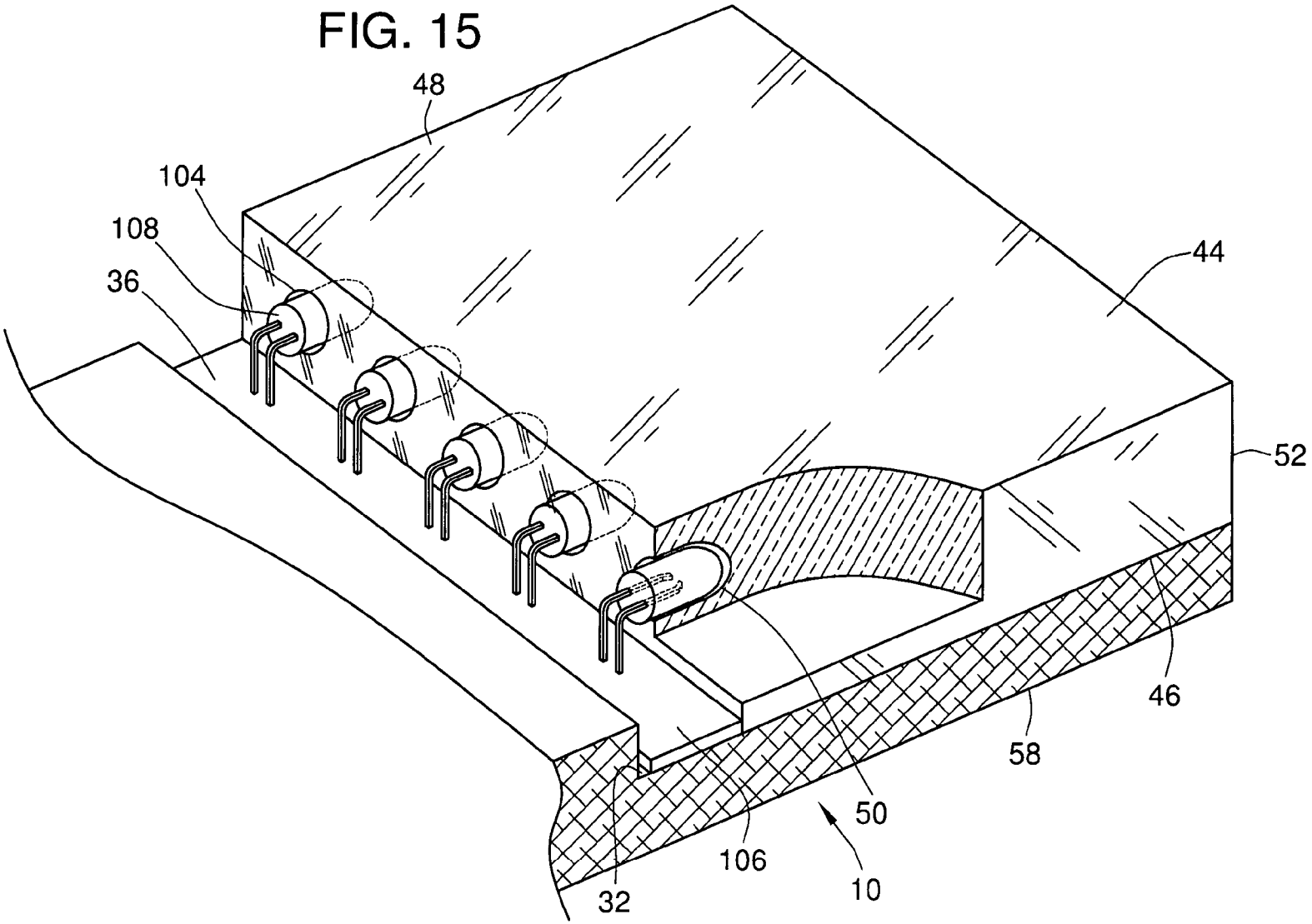
FIG. 15 is an enlarged, fragmentary, partially cross-sectional perspective view of a counter, a light source, and a light guide constructed in accordance with teachings of the invention.

All of the light guide embodiments positioned between the underside 32 of the counter 10 and the upper flange 30 of the sink 12 may also be adapted or created with a channel 94, as shown in FIGS. 9-14. Although this is an optional element of the light guide 44, this channel 94 within the light guide 44 may be desirable to some users because it is capable of accommodating the light source 36. Instead of mounting the light source 36 to the underside 32 of the counter 10, the light source 36 may be placed within this channel 94. In FIGS. 9-12, the channel 94 is depicted with a slight lip 96 to help retain the light source 36, however, the channel 94 need not necessarily contain such a lip 96. Additionally, all of the light guide embodiments positioned between the underside 32 of the counter 10 and the upper flange of the sink 30 may be adapted or created with a light source accommodating cavity 104, as shown in FIG. 15.

The light source 36 itself may be of any appropriate design. In FIG. 15, for example, the light guide 44, counter 10, and light source 36 are depicted upside down and the light guide 44 is cut away to clearly show the light source accommodating cavity 104. A circuit board 106 is shown disposed subjacent to the underside 32 of the counter 10. Attached to the circuit board 106 are a series of light emitting diodes (LEDs) 108. The combination of the circuit board 106 and series of LEDs 108 are the light source 36 in this embodiment. As shown, the light receiving surface 50 is the surface of the light guide 44 which defines the light source accommodating cavity 104. The LEDs 108 are inserted into the light source accommodating cavities 104. When a power supply (not shown) is connected to the light source 36 and activated, the LEDs 108 emit light into the light receiving surface 50. The light travels through the light guide 44 and exits through the light exposing surface 52 to illuminate an under mount sink 12.

Figure 16A:
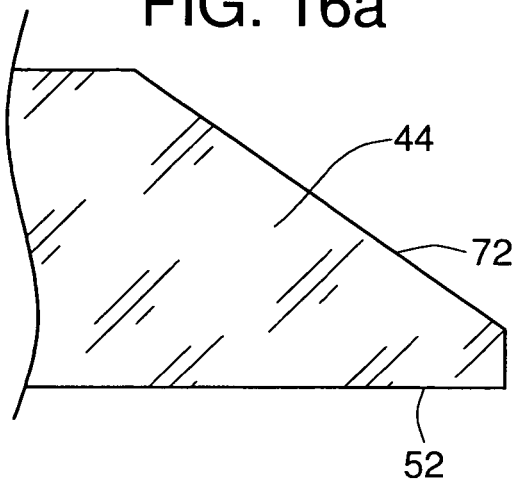
FIG. 16*a* is a fragmentary cross-sectional view of a light guide constructed in accordance with teachings of the invention.
Figure 16B:
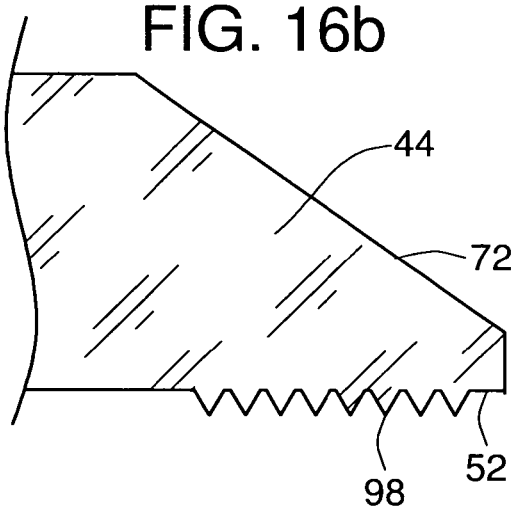
FIG. 16*b* is a fragmentary cross-sectional view of an alternate embodiment of a light guide constructed in accordance with teachings of the invention.
Figure 16C:
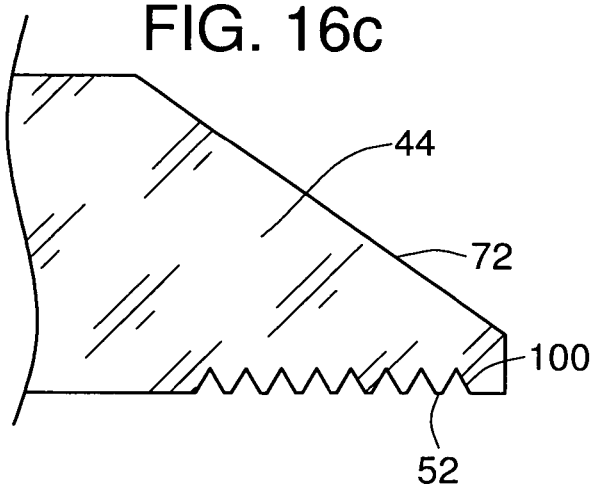
FIG. 16*c* is a fragmentary cross-sectional view of another alternate embodiment of a light guide constructed in accordance with teachings of the invention.

It will be appreciated by those of skill in the art that any appropriate shape of light guide may be utilized, including, by way of example only, the arrangements shown in FIGS. 16*a*-16*c*. Some light sources 36, such as fluorescent tubes, provide a relatively even distribution of light along its entire length. When the light distribution is relatively even, the light exposing surface 52 works well when relatively flat as shown, for example, in FIG. 16*a*. Not all light sources 36, however, provide a relatively continuous stream of light along its length. For example, an LED on a rigid printed circuit board has a point of high intensity at the LED with a lower intensity in between consecutive LEDs. In order to diffuse points of light, and of relatively higher intensity light in particular, the light exposing surface 52 of the light guide 44 may have a plurality of ridges 98, as shown in FIG. 16*b*, or recesses 100, as in FIG. 16*c*, used to provide a more continuous stream of light as the light exits the light exposing surface 52 and enters the sink basin 26. The ridges 98 and recesses 100 are depicted as triangular, but they may instead be semicircular or any other shape capable of diffusing light. A flat light exposing surface or a light exposing surface with light diffusion ridges 98 or recesses 100 may be used on any or all of the light guide embodiments disclosed herein.

For simplicity, the light source 36 in most of the figures is depicted with a circular or generally rectangular cross-section. It will be appreciated, however, that the light source 36 may have an alternate cross-section, such as, for example, generally rectangular cross-section. The light source 36 may be any suitable lighting known in the art including, but not limited to, incandescent light bulbs, neon lighting, fluorescent lighting, cold cathode, light emitting diode (LED), electroluminescent wire, and fiber optic light fiber. If LEDs are used, they may be discrete LEDs on a rigid, semi-rigid, or flexible strip or rope LEDs. Additionally, depending on the type of light source 36 selected, the light source 36 may be chosen from a variety of different colors. This might be done, for example, to match the walls or design scheme of a room. The light source 36 may also be adapted to change colors automatically or in response to some form of input by a user. By way of example and not limitation, the user may decide to use multicolored LEDs during the winter holidays such that the light provided by the light source 36 changes from green to red every few seconds. Additionally, the light guide itself may be made of one or more colors of translucent material to emit light of a particular color into the sink.

The light source 36 may be affixed to the underside 32 of the counter 10 or within the light guide 44 by any means known in the art. For example, the light source 36 may be friction fit to retain within a channel 34 in the underside 32 of the counter 10 or within a channel 94 of the light guide 44. Alternately, the light guide 44 may be affixed with adhesive, Velcro, brackets, clips, tacks, or rest on a shelving support attached to the underside 32 of the counter 10.

Although certain embodiments of the light guide may be shown and/or described as being exposed or not exposed to a user, it will be appreciated that any suitable embodiment of the light guide may be mounted such that it is exposed or not exposed to a user.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of illuminating an under mount sink having an upwardly opening end and an upper flange, the under mount sink having the upwardly opening end disposed subjacent a counter comprising:

disposing a light source below a top surface of the counter and proximate to the upwardly opening end of the under mount sink, disposing a light guide below the top surface of the counter for guiding light from the light source to the under mount sink, affixing the under mount sink to an underside of the counter such that the light guide is compressed between the underside of the counter and the upper flange of the under mount sink, and supplying power to the light source, such that the under mount sink is illuminated by the light source when the power source is activated.

2. The method of claim 1 further comprising, disposing an opaque light shield adjacent to the light guide.

3. The method of claim 1 further comprising, providing a plurality of ridges on the light guide to diffuse light.

4. The method of claim 1 further comprising, providing a plurality of recesses on the light guide to diffuse light.

5. The method of claim 1 further comprising, creating a channel below the top surface of the counter and disposing the light source within the channel.

6. The method of claim 5 further comprising, disposing a light guide to cover an opening of the channel.

7. The method of claim 1 wherein the light source comprises a plurality of light emitting diodes.

8. The method of claim 1 wherein the light source emits visible light.

9. An illuminated under mount sink arrangement for placement subjacent a counter having a top surface, and for connection to a power supply comprising:

an under mount sink defining a bowl having an upwardly opening end and having an upper flange, a light source placed below the top surface of the counter and proximate to the upwardly opening end of the under mount sink, a light guide disposed below the top surface of the counter for guiding light from the light source to the under mount sink, the light guide being compressed between the underside of the counter and the upper flange of the under mount sink, and the light source being connected to the power supply, such that the light source illuminates the under mount sink when the power supply is activated.

10. The arrangement of claim 9 wherein an opaque light shield is disposed adjacent to the light guide.

11. The arrangement of claim 9 wherein a channel is provided in the light guide to dispose the light source within.

12. The arrangement of claim 9 wherein the light guide has a plurality of ridges to diffuse light.

13. The arrangement of claim 9 wherein the light guide has a plurality of recesses to diffuse light.

14. The arrangement of claim 9 wherein the light source is disposed in a channel provided in the counter.

15. The arrangement of claim 14 wherein a light guide is provided to cover an opening of the channel.

16. The arrangement of claim 9 wherein the light source emits visible light.

17. A device for connection to a power source and for illuminating an under mount sink when disposed subjacent a top surface of a counter, the under mount sink comprising an open bowl having an upwardly opening end and an upper flange, comprising:

a light source adapted to selectively emit light, and a body made of a translucent material, wherein the body further comprises:

a first mounting surface whereby the body is adapted to be disposed below the top surface of the counter, a second mounting surface whereby the body is adapted to be disposed above the upper flange of the sink, a light receiving surface adapted for receiving light from the light source, and a light exposing surface adapted for exposing light into the under mount sink, such that when the first mounting surface of the body is placed below the top surface of the counter and the second mounting surface is placed above the upper flange of the sink such that the body is compressed between the counter and the upper flange of the sink, and a light source is disposed near the light receiving surface, light from the light source travels through the body and exits from the light exposing surface to provide illumination to the upwardly opening end of the under mount sink.

18. The device of claim 17 wherein the body further comprises an angled surface to deflect light substantially toward the light exposing surface.

19. The device of claim 17 wherein the light receiving surface and the light exposing surface contiguously lie in the same plane.

20. The device of claim 17 further comprising an opaque light shield disposed adjacent to the body.

21. The device of claim 17 wherein a plurality of ridges are provided on the light exposing surface.

22. The device of claim 17 wherein a plurality of recesses are provided on the light exposing surface.

23. The device of claim 17 wherein the body further comprises a channel to accommodate the light source.

24. The device of claim 17 wherein the light receiving surface defines a cavity to accommodate the light source.

25. The device of claim 17 wherein the light source emits visible light.

* * * * *